US005301375A

United States Patent [19]

Osmond

[11] Patent Number: 5,301,375

[45] Date of Patent: Apr. 12, 1994

[54] PRIMER TANK-CHECKVALVE SYPHON TOILET FLUSHING APPARATUS

[76] Inventor: John S. Osmond, 731 Cedar St., Santa Monica, Calif. 90405

[21] Appl. No.: 28,399

[22] Filed: Mar. 9, 1993

[51] Int. Cl.[5] ..... E03D 1/06

[52] U.S. Cl. ..... 4/368; 137/142

[58] Field of Search ..... 4/368, 373, 374, 375, 4/376; 137/134, 142

[56] References Cited

U.S. PATENT DOCUMENTS

| | | | |
|---|---|---|---|
| 1,104,292 | 7/1914 | Cowperthwaite | 4/368 X |
| 1,461,673 | 7/1923 | Papin | 4/375 X |
| 5,113,536 | 5/1992 | Osmond | 4/368 |

FOREIGN PATENT DOCUMENTS

| | | | |
|---|---|---|---|
| 0029500 | 8/1907 | Austria | 4/377 |
| 0057606 | 4/1940 | Denmark | 4/375 |
| 0001839 | of 1893 | United Kingdom | 4/368 |
| 0012717 | of 1893 | United Kingdom | 4/376 |

*Primary Examiner*—Robert M. Fetsuga
*Attorney, Agent, or Firm*—William H. Maxwell

[57] ABSTRACT

A toilet flushing apparatus characterized by an inherently leakproof syphon having a bridge substantially spaced above a supply tank water level, a manually discharged primer tank that floods a suction leg of the syphon to initiate flow over the bridge and through a discharge leg, and a floating flush valve and control for discharge of primer tank water to fill the suction leg closed by an inlet check valve at the foot of the suction leg, followed by continued syphoning, the primer and supply tank being automatically refilled by a float control.

18 Claims, 2 Drawing Sheets

PRIMER TANK-CHECKVALVE SYPHON TOILET FLUSHING APPARATUS

BACKGROUND OF THE INVENTION

A common flushing apparatus for toilets involves a reseating flush valve that holds a large volume of supply water in a tank from which it is suddenly released into the toilet bowl. And, a float valve is responsive to the water level in the tank to replace the water level, operating automatically and separately from the flush valve that is manually operated by movement of a flush handle or lever that is turned to lift the flush valve. A detrimental feature of this common system is that the flush valve tends to and eventually leaks, resulting in continued water waste.

Another flushing apparatus, common in the United Kingdom, involves a syphon tube having its suction leg depending into the supply tank so as to be filled with water, and its discharge leg normally empty of water and opening into the toilet bowl, and operated by means of a primer pump that is manually actuated to fill the discharge leg thereby initiating syphoning. The said primer pump operates as a water lifting means in the suction leg of the syphon, and the advantage of this syphon system is that there can be no leakage from the supply tank through the inactive syphon. Another feature of the United Kingdom toilet flushing apparatus is the prescription of a "Warning Pipe" flush tank overflow specified to be 64 mm or 2½ inches below the bridge of the syphon, thus determining the maximum water level in the flush tank.

In view of the foregoing, it is an object of this invention to employ the aforesaid syphon tube flush principle of operation to the exclusion of a pump means, and replacing the aforesaid pump-type primer means with a tank-type primer means and flush valve in combination with a suction check valve that is operable with toilets having a "Warning Pipe" prescribing supply tank water level to be substantially lower than the syphon bridge.

The syphon principle of operation is superior with respect to the conservation of water, in that there can be no continuous leakage therethrough when its discharge leg is empty of water. And only when the discharge leg is primed does water flow therethrough. On the contrary, the conventional flush valve principle of operation is prone to continuous leakage from the water supply tank and through the flush tube, due to deterioration of either the valve seat or valve ball. It becomes apparent therefore that the syphon principle is superior, except for the inevitable deterioration of the pump means therefor which is a flap or disc of flexible material that lifts the tank water into the syphon and initiates continued flow therethrough until the water supply tank is emptied through the flush tube. Accordingly, these two widely used principles of operation are each subject to deficiencies, one to inherent leakage and the other to eventual inoperation. In view of the foregoing, it is an object of this invention to provide a toilet flushing apparatus that virtually eliminates leakage of the flush water, and that provides automatic refilling of the primer tank for repeated flushings.

It is also an object of this invention to employ the aforesaid syphon tube principle of operation to the exclusion of a pump means, and replacing the aforesaid pump-type primer means with a tank-type primer means, flush valve and suction check valve.

It is to be understood that the water supply tank is refilled after each flushing operation, or incomplete flushing operation, by means of a conventional and accepted water level responsive valve means from a water supply service pipe. In practice, a float controlled valve returns the tank water to a level below the "Warning Pipe" and substantially below the bridge of the syphon after each flushing operation, complete or incomplete. And it is this float controlled water that overflows from the primer tank and automatically refills the supply tank.

Referring now to the prior art as represented by my U.S. Pat. Nos. 5,113,536 and 5,109,552; my earlier filed '536 patent entitled Jet Activated Toilet Flushing Apparatus discloses a toilet flushing apparatus characterized by an inherently leakproof syphon, primer and flush tube aligned with a flush pipe into the toilet, with a jet opening from the discharge of the syphon to initiate flushing when a charge of water is manually dumped from a bucket and through the flush tube; and, my later filed '552 patent entitled Primer Tank Toilet Flushing Apparatus discloses a toilet flushing apparatus characterized by an inherently leakproof syphon, a manually discharged primer tank initiating syphoning through a discharge tube and toilet flush tube, and with a floating flush valve and control for complete discharge of primer water followed by immediate closure to ensure continued syphoning, the primer tank being automatically refilled with the rise of float controlled supply tank water.

The syphon principle of operation is characterized by two conditions, a passive condition wherein the suction leg has a water level substantially below the bridge and the discharge leg is dry, and a functioning condition where the suction leg and discharge leg are flooded. In order to achieve said flooded condition of the two syphon legs, priming is required for completely filing the otherwise low level suction leg before flooding the dry discharge leg, whereby syphoning action is initiated and continues to occur. It is an object of this invention to sequentially prime the two syphon legs by discharging a relatively small volume of water sequentially into the suction leg and then into the discharge leg, so as to initiate the syphon effect. In practice, flooding of the two syphon legs enables the syphon to function with sudden high velocity of water therethrough.

The sudden termination of primer tank water and closure of the syphon to atmosphere before air enters therein is a prerequisite to successful flushing, and to this end it is an object of this invention to provided flush valve control means by which the flush valve closes as and when the primer tank water is depleated, thereby shutting off the outside atmosphere for continued syphoning.

The flush valve is a conventional floating ball type valve. In practice, shut-off is by means that lifts and drops the flush valve. As shown, the primer tank is fixed and flushing control relegated to the flush valve and reliant upon water supply of float valve filling of the supply tank. However, in the event of a flush valve leak or malfunction, the primer tank water can be lost, but only this small quantity of water can be wasted.

SUMMARY OF THE INVENTION

This invention relates to water closets or toilets and particularly to the flushing apparatus therefor by which defecation and urnination etc. is disposed of as sewage. Heretofore, substantial quantities of water have been wasted by the flushing apparatus employed, as by inherent leakage and by mechanical deterioration resulting in malfunctions and/or insufficient operation requiring repeated flushing attempts. The flush valve type apparatus that is manually activated to open the conventional flush tube is subject to continuous leakage and waste of water, while the non-leak syphon and "Warning Pipe" apparatus inevitably deteriorates mechanically and eventually becomes inoperative. However, it is an object of and this invention to combine the advantage of the syphon type "Warning Pipe" apparatus with a primer means, whereby the pump means is eliminated and the lower water level imposed by the "Warning Pipe" prescription is not a disadvantage as it has been in the past.

The toilet flushing apparatus herein disclosed is primer tank activated, simply by flooding the suction tube of the syphon followed by flooding the transfer passage and discharge leg in order to initiate syphoning that depleats the supply tank during each flushing operation. Accordingly, this invention is characterized by a primer tank that is raised so as to establish a sufficient head of primer water that is released by a floating flush valve to flood the syphon and close without the admission of outside air. In practice, initiation of the syphon effect requires but a small volume of water, a pint or two, is discharged so as to flood the suction leg of the syphon. It is to be understood that operation of this flushing apparatus is dependent upon refilling the primer tank which overflows to fill the supply tank that is float controlled so that the tank water returns to the "Warning Pipe" level after each flushing.

The foregoing and various other objects and features of this invention will be apparent and fully understood from the following detailed description of the typical preferred forms and applications thereof, throughout which reference is made to the accompanying drawings.

THE DRAWINGS

PREFERRED EMBODIMENT

Figure 1:
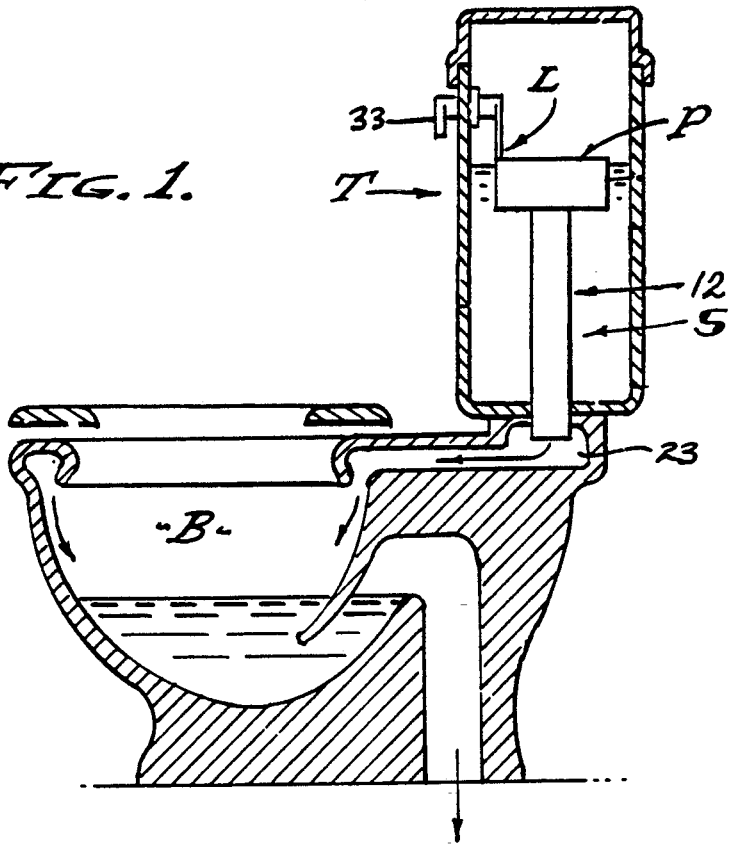
FIG. 1 is a cross sectional view of a toilet with the flushing apparatus of the present invention installed therein.
Figure 2:
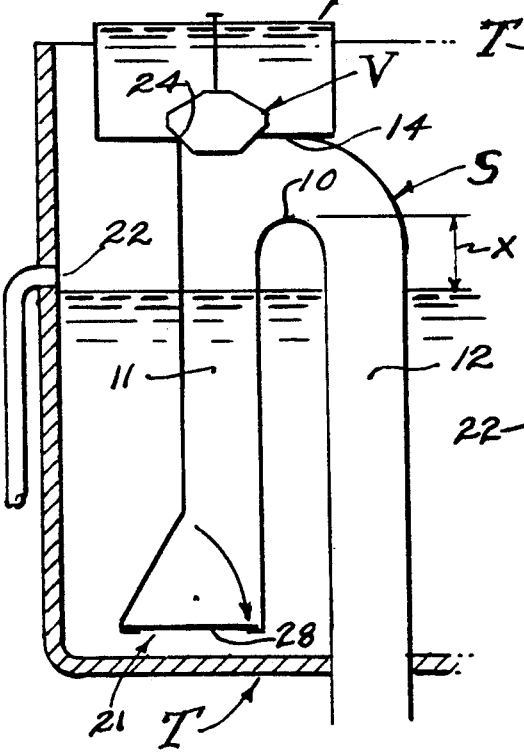
FIGS. 2 and 3 are enlarged sectional views of the syphoning apparatus, FIG. 2 showing the passive condition ready for flushing, and FIG. 3 showing the activated condition and initiation of the syphon effect.

Referring now to the drawings, the toilet and water supply tank T are conventional in every respect. And, the tank water level is controlled by a conventional float valve, so that the water supply level reaches a predetermined position well below a weir or bridge 10 of a syphon S within the tank. In accordance with this invention, there is the syphon S comprised of a suction leg 11 and a discharge leg 12, the discharge leg 12 opening into a flush tube 23. The suction leg 11 opens from the bottom of the tank T and over the bridge 10 and into the top of the discharge leg 12 via a header 14, the suction leg 11 being filled with tank water to a level x substantially below the bridge 10 level (see FIG. 2). The discharge leg 12 is drained empty after each flushing. The header 14 is closed by a flush valve V forming a transfer passage joining the two legs. A feature is the valve seat 24 opening through the header over the suction leg 11 laterally of the discharge leg 12, this valve seat opening being substantially the same in diameter as and in vertical alignment with the suction leg 11. The transfer passage beneath the header 14 is empty in the passive condition when the water level rises to a maximum below the bridge 10 of the syphon. The discharge leg 12 and said upper transfer passage remain empty of water after each flushing, while the suction leg 11 refills.

The toilet fixture is conventional, having a water supply tank T that is automatically filled with water by means of a float 25 controlled valve 26 from a water supply pipe 27. The water level in tank T is limited to a predetermined point substantially below the bridge 10 of the syphon S, as is required by an overflow discharge 22 of the warning pipe, from the supply tank T. The United Kingdom requirement for dimension x is 64 mm or 2½ inches. The syphon discharges through flush tube 23 and into the toilet bowl B for flushing in the usual manner, as is clearly shown in the drawings.

Figure 3:
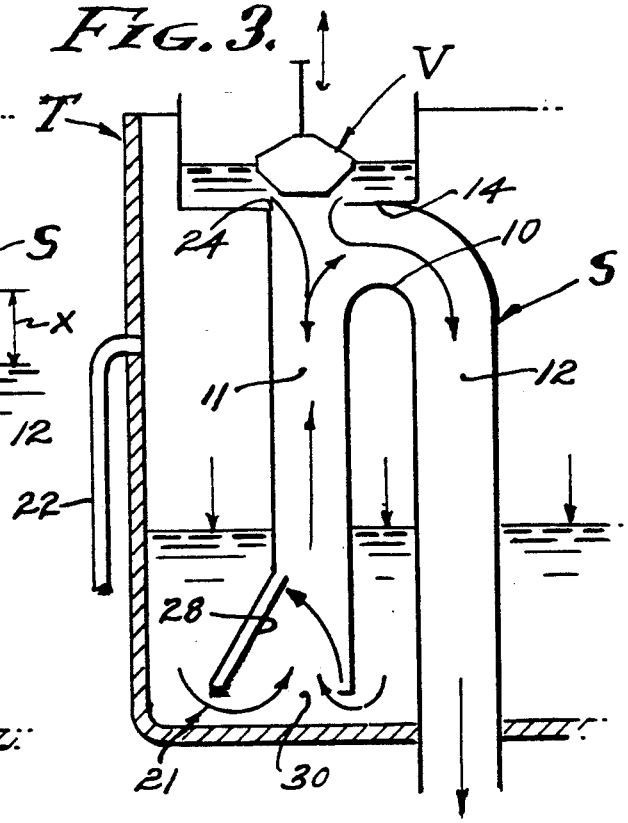

In accordance with this invention there is a raised primer tank P, the suction leg 11 and discharge leg 12 being flooded thereby with water that falls by gravity into the transfer passage and over the bridge 10 of the syphon. Flooding of the suction leg 11 is a positive function made possible by a suction check valve 21 at the foot of the suction leg 11 (see FIGS. 2 and 3), sufficient to initiate the syphoning effect causing the tank T water to rise in the suction leg 11 and to then flow through the transfer passage and over the bridge and into the discharge leg. Syphoning inherently continues when the flush valve V is closed, as will be described. The discharge area of the transfer passage into the discharge leg 12 is substantially the same as the cross sectional areas of suction leg 11 and of the flush tube 23 into the toilet bowl. Accordingly, there is a continuous rush of flush water from the syphon S and into the toilet bowl.

The primer tank P is fixedly raised for flushing and automatic filling with supply tank water supplied by the float level control valve 26. The flush valve V retains the primer tank water only, ready to be dumped into the syphon S, and it is a feature of this primer tank P that it need only be discharged and immediately closed to the syphon S.

Figure 6:
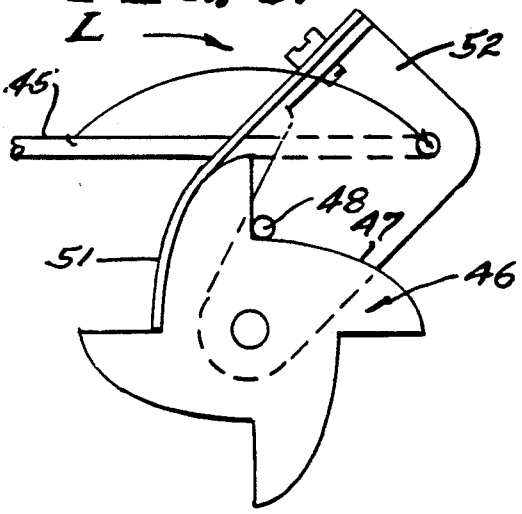
FIGS. 6–8 illustrate the control means for the float valve, in a passive, partially actuated, and fully actuated positions.
Figure 7:
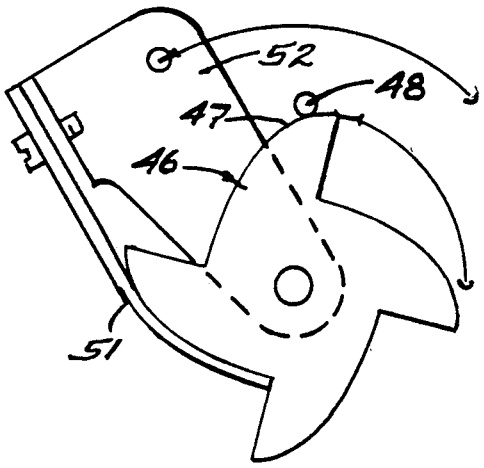
Figure 8:
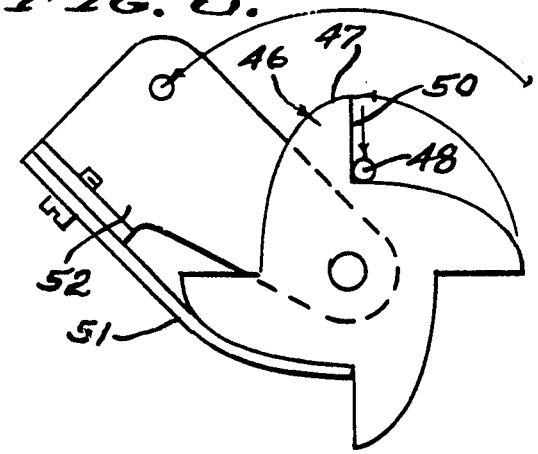

The bottom of the primer tank P is opened by the flush valve V lifted from a seat 24, this function being provided by lift means L as best illustrated in FIGS. 6–8 of the drawings. A necessary feature of this invention is the immediate release of the flush valve V after it is unseated, so that it is permitted to float upon and downward with the primer tank water and reseat before the primer tank water is depleated. Accordingly, the flush valve V is a float valve, essentially a hollow ball or the like.

Figure 4:
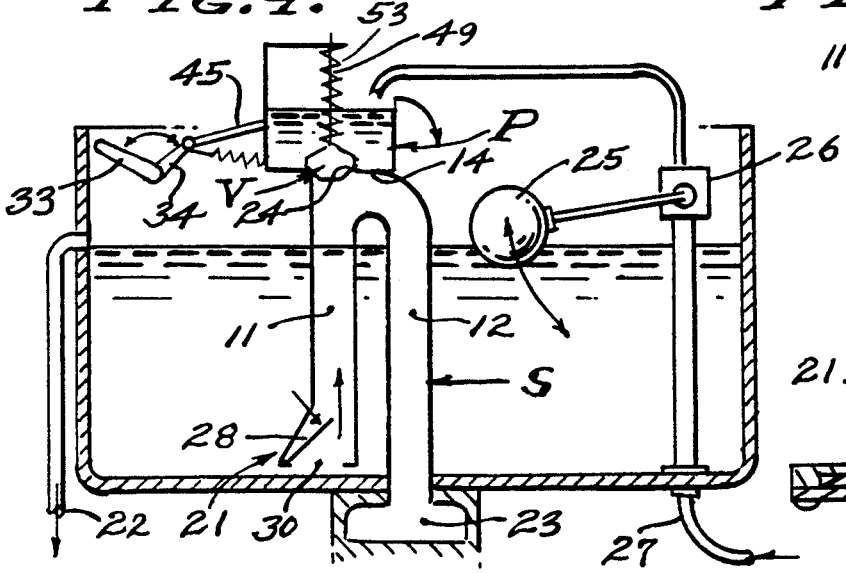
FIG. 4 illustrates the flush tank installation of the apparatus.

The primer tank P is automatically filled with water by means of the float 25 controlled valve 26, through a filler pipe as shown, and it overflows when filled so as to spill into tank T and lifting the float 5 to a limit (see FIG. 4). A feature is that the valve seat 24 is coincidental with the plane of the header 14, so that all of the tank water can be discharged.

In accordance with this invention, means is provided to open the primer tank P to dump its water into the legs 11 and 12 of the syphon S, this water discharge function being performed by the combination of lifting means L that raises and opens the flush valve V. As shown, there is a manually operable handle 33 that turns a bellcrank 34 (90°). A pull rod 45 extends to a lift means in the form of a cam 46 rotatable on a horizontal axis or trunnion positioned at the top side of the primer tank P. The cam 46 has three conditions as follows: (1) A passive condition as shown in FIG. 6 wherein a lift bar 48 rests upon a radially depressed portion of the cam face 47, so that the flush valve V attached to said lift bar by a stem 49 remains seated as shown in FIG. 4. (2) An actuated condition as shown in FIG. 7 wherein the lift bar 48 is lifted upon a radially displaced portion of the cam face 47, so that the flush valve V is unseated to float upon the primer tank water, with the seat 24 fully open into the suction leg 11 and laterally into the discharge leg 12. And, (3) A syphoning condition as shown in FIG. 8 wherein the lift bar 48 is released over a step 50 so that the flush valve V is free to float downward and reseat when the primer tank water is depeated.

In practice, the lifting means L is a rotary ratchet comprised of a toothed wheel having a multiplicity of cams 46, each as above described, and advanced one at a time by a spring pawl 51 operated by a lever 52 oscillated by the pull rod 45, as shown. The primer tank P is opened by the flush valve V lifted from the seat 24, the function being provided by the cam 46 as best illustrated in FIGS. 6–8. In practice, there is a return spring (as shown) that pulls the lever 52 to the passive condition of FIG. 6. Although gravity can be relied upon to return the flush valve V to a closed position on the seat 24 over the open top end of suction leg 11, a light compression spring 53 carried over the stem 49 by a guide bracket depresses said flush valve and ensures rapid seating.

Figure 5:
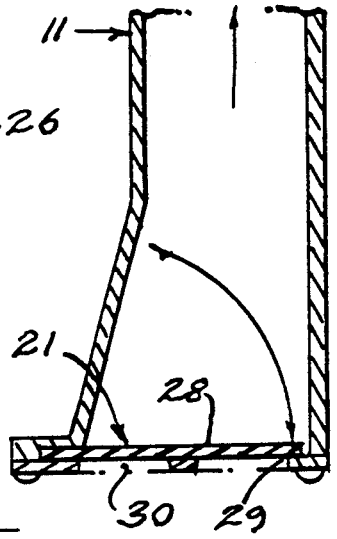
FIG. 5 is an enlarged sectional view of the suction leg foot valve that checks suction flow.

In accordance with this invention the syphoning function is ensured by providing the footvalve or check valve 21 at the bottom inlet end of the suction leg 11, as shown in FIGS. 2–5. This inlet check valve prevents back flow and can vary widely in form. A basic flapper valve is shown as a flexible flap member 28 that drops onto an upwardly facing seat 29 that surrounds the inlet opening 30 of suction leg 11 (see FIG. 2), the passive closed condition that ensures flooding of the suction leg 11 so as to enable initiation of the syphon effect. The syphon effect creats inlet suction that instantly opens the check valve 21, so that syphoning then continues until the supply tank T is depleated of water (see FIG. 3). As shown in FIG. 5, the flap member 28 is a flat piece of rubber or the like adapted to interface with the planar seat 29 when closed, and to bend upwardly against an inner wall of the suction leg inlet when opened for free flow of supply tank water (see FIG. 3).

From the foregoing it will be understood how the syphon function is inititated by dumping a charge of water from the raised primer tank and into the transfer passage over the suction leg of the syphon. It is significant that the water level in the suction leg 11, as defined by dimension x is immediately raised so as to flood over the bridge of the syphon S, and this initiates the syphoning effect. And, the flush valve V floats downward upon the primer tank water and reseats before the primer tank water is depleated and thereby closes the syphon to surrounding atmosphere to ensure continued syphoning effect.

Having described only the typical and preferred forms and applications of my invention, I do not wish to be limited or restricted to the specific details herein set forth, but wish to reserve to myself any modifications or variations that may appear to those skilled in the art, as set forth within the limits of the following claims.

I claim:

1. A flushing apparatus for toilets having a flush tank and a flush tube opening therefrom and into a toilet bowl, and having a water level control means responsive to depletion of water in said tank to refill said tank to a predetermined water level, said apparatus including;

a syphon adapted to be positioned within the flush tank and comprised of a suction leg sized to open adjacent the bottom of said tank and extending upward to a bridge adapted to be positioned substantially above said predetermined water level, and a discharge leg continuing from the suction leg and extending downward from the bridge for discharging into the aforesaid flush tube of the toilet, a header overlying the suction leg and discharge leg and spaced above the bridge to define a transfer passage, there being an inlet check valve in the suction leg, a primer tank adapted to be filled with water by said water level control means and disposed over said header and with a valve seat opening therefrom and into said transfer passage, and a flush valve passively closing the valve seat and having control means for opening said flush valve to flood the suction leg for inducing a syphoning effect from the suction leg and into the discharge leg, whereby water from the suction leg is drawn over the bridge and continuously into the discharge leg.

2. The flushing apparatus for toilets as set forth in claim 1, wherein the seat opening from the primer tank is open directly to the suction leg to flood the same.

3. The flushing apparatus for toilets as set forth in claim 1, wherein the seat opening from the primer tank is open indirectly to the discharge leg to flood the same through the transfer passage.

4. The flushing apparatus for toilets as set forth in claim 1, wherein the seat opening from the primer tank is open directly to the suction leg and indirectly to the discharge leg to flood the suction leg followed by flooding the discharge leg through the transfer passage.

5. The flushing apparatus for toilets as set forth in claim 1, wherein the inlet check valve is a foot valve at a bottom opening of the suction leg.

6. The flushing apparatus for toilets as set forth in claim 1, wherein the inlet check valve is a flapper valve disengageable from an upwardly facing seat opening into the suction leg.

7. The flushing apparatus for toilets as set forth in claim 1, wherein the flush valve is floatable, said control means opening the passively closed flush valve by unseating the same to float upon the primer tank water and to be reseated before the primer tank water is depleated through said seat opening from the primer tank.

8. The flushing apparatus for toilets as set forth in claim 7, wherein the control means is a manually operable lift means with a step over which a lift bar on the flush valve is raised and then released to float the flush valve on the primer tank water.

9. The flushing apparatus for toilets as set forth in claim 7, wherein the control means is a manually rotatable cam means with a lift face and a step over which a lift bar on the flush valve is raised and then released to float the flush valve on the primer tank water.

10. A flushing apparatus for toilets having a flush tank and a flush tube opening therefrom and into a toilet bowl, and having a water level control means responsive to depletion of water in said tank to refill said tank to a predetermined water level immediately below an overflow discharge from the flush tank, said apparatus including;

a syphon adapted to be positioned within the flush tank and comprised of a suction leg sized to open adjacent the bottom of said tank and extending upward to a bridge, and a discharge leg continuing from the suction leg and extending downward from the bridge for discharging into the aforesaid flush tube of the toilet, a header overlying the suction leg and discharge leg and spaced above the bridge to define a transfer passage, there being an inlet check valve in the suction leg, a primer tank adapted to be filled with water by said water level control means and disposed over said header and with a valve seat opening therefrom and into said transfer passage, and a flush valve passively closing the valve seat and having control means for opening said flush valve to flood the suction leg for inducing a syphoning effect from the suction leg and into the discharge leg, whereby water from the suction leg is drawn over the bridge and continuously into the discharge leg.

11. The flushing apparatus for toilets as set forth in claim 10, wherein the seat opening from the primer tank is open directly to the suction leg to flood the same.

12. The flushing apparatus for toilets as set forth in claim 10, wherein the seat opening from the primer tank is open indirectly to the discharge leg to flood the same through the transfer passage.

13. The flushing apparatus for toilets as set forth in claim 10, wherein the seal opening from the primer tank is open directly to the suction leg and indirecly to the discharge leg to flood the suction leg followed by flooding the discharge leg through the transfer passage.

14. The flushing apparatus for toilets as set forth in claim 10, wherein the inlet check valve is a foot valve at a bottom opening of the suction leg.

15. The flushing apparatus for toilets as set forth in claim 10, wherein the inlet check valve is a flapper valve disengageable from an upwardly facing seat opening into the suction leg.

16. The flushing apparatus for toilets as set forth in claim 10, wherein the flush valve is floatable, said control means opening the passively closed flush valve by unseating the same to float upon the primer tank water and to be reseated before the primer tank water is depleated through said seat opening from the primer tank.

17. The flushing apparatus for toilets as set forth in claim 16, wherein the control means is a manually operable lift means with a step over which a lift bar on the flush valve is raised and then released to float the flush valve on the primer tank water.

18. The flushing apparatus for toilets as set forth in claim 16, wherein the control means is a manually rotatable cam means with a lift face and a step over which a lift bar on the flush valve is raised and then released to float the flush valve on the primer tank water.

* * * * *